United States Patent [19]

Ono et al.

[11] 4,292,614

[45] Sep. 29, 1981

[54] ELECTROMAGNETIC RELAY

[75] Inventors: Kenji Ono, Yawata; Hidetoshi Matsushita, Ibaraki; Minoru Shibata, Kadoma, all of Japan

[73] Assignees: Matsushita Electric Works, Ltd., Osaka, Japan; Hans Sauer, Deisenhofen, Fed. Rep. of Germany

[21] Appl. No.: 69,356

[22] Filed: Aug. 24, 1979

[30] Foreign Application Priority Data

Aug. 29, 1978 [JP] Japan ..... 53-106045
Mar. 13, 1979 [JP] Japan ..... 54-29014

[51] Int. Cl.[3] ..... H01H 45/04
[52] U.S. Cl. ..... 335/202; 335/132
[58] Field of Search ..... 335/202, 132

[56] References Cited

U.S. PATENT DOCUMENTS

| | | | |
|---|---|---|---|
| 3,717,829 | 2/1973 | Flaherty | 335/202 |
| 3,893,194 | 7/1975 | Hayden et al. | 335/202 |
| 4,032,871 | 6/1977 | Sauer | 335/202 |
| 4,045,752 | 8/1977 | Frigo | 335/202 |
| 4,091,346 | 5/1978 | Nishimure et al. | 335/202 |

OTHER PUBLICATIONS

West German Utility Model Specification No. 7,144,972, 10-8-72.

*Primary Examiner*—Harold Broome
*Attorney, Agent, or Firm*—Schwartz, Jeffery, Schwaab, Mack, Blumenthal & Koch

[57] ABSTRACT

Electromagnetic relay having a coil-wound bobbin with flanges at each end, a reed mounted on one flange and extending through the bobbin, fixed contacts mounted on the other flange cooperating with a free end of the reed, and a casing formed by a base and a cover. An upwardly projecting peripheral wall is provided on the base, and the lower edge of the cover engages the peripheral wall. Coil, reed and contact terminals extend through bores formed in the casing base. Grooves in the lower side of the base communicate with the bores and with the lower ends of passages which emerge at the peripheral wall. Sealant filled in the grooves simultaneously seals the terminals in the bores and the cover to the base. When the cover engages the interior of the peripheral wall, webs provided on the upper side of the casing base confine the sealant to the bores and to pockets provided at the outer side of the cover. The bobbin flange interior has a separator against which the fixed contacts abut to define the spacing between the fixed contacts. The separator also defines the spacing between the free end of the reed and a permanent magnet which cooperates with pole shoes connected to the fixed contacts.

15 Claims, 22 Drawing Figures

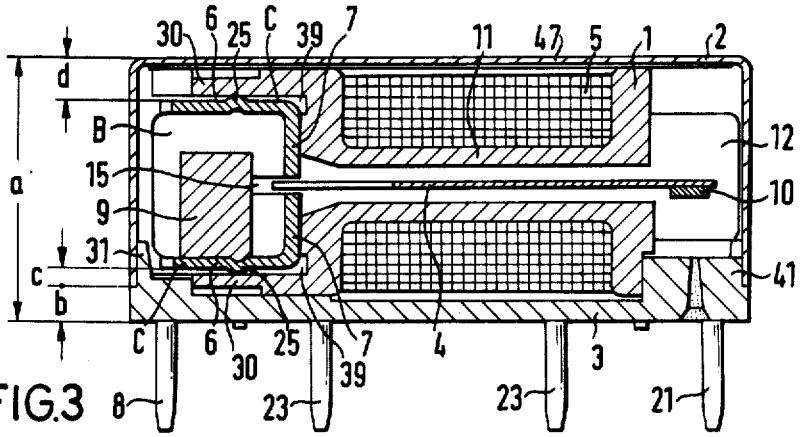
FIG.3
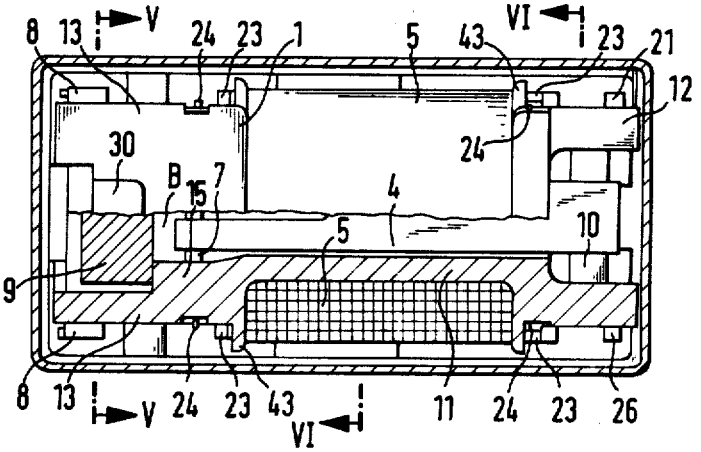
FIG.4
FIG.5
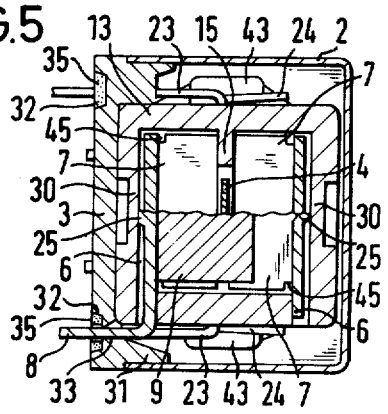
FIG.6
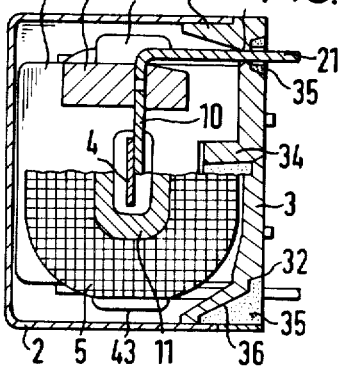

FIG.9
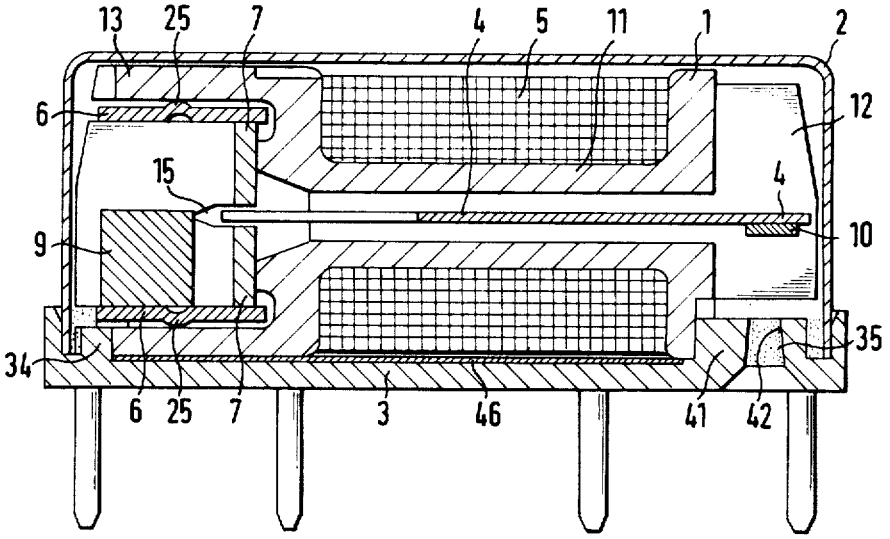
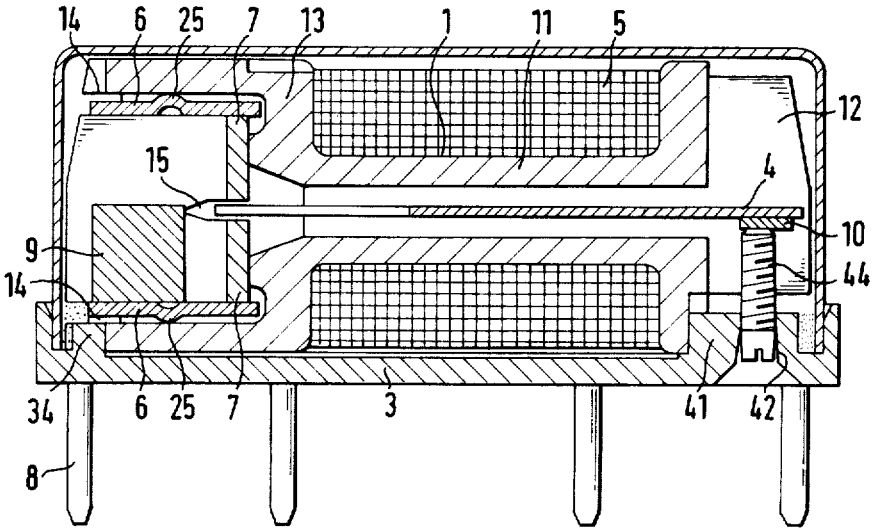
FIG.16

ELECTROMAGNETIC RELAY

BACKGROUND OF THE INVENTION

This invention relates to an electromagnetic relay.

West German Utility Model Specification No. 7 144 972 discloses an electromagnetic relay having a coil wound on a bobbin, at least one movable contact and one fixed contact, and a casing including a base having bores in its bottom wall through which contact and coil terminals pass, and a cover having its lower edge engaging the upper side of the base. The space between the cover, the base and the relay body is filled with a sealant. To provide some means for positioning the relay body within the casing, simultaneously achieving a safe electrical insulation between the cover, which may consist of metal, and voltage carrying portions of the relay such as the contact terminals, an intermediate layer of insulating material or an insulating spacer must be provided between the cover and the relay body. Further and more exact fixing of the relay body within the casing, which would be desirable for structural and electrical reasons, might perhaps be achieved by accordingly dimensioning the intermediate layer or the spacer, e.g. by forming these portions with increased thickness. This, however, is apt to impede the sealant flow, thereby preventing a uniform and bubble-free embedding of the relay body at all sides thereof. After the relay body has been embedded in the sealant, an additional manufactural step is required to join the plane base plate with the unit thus obtained, which is a further drawback of the known relay.

U.S. Pat. No. 4,091,346 discloses a further relay, in which the base portion of the casing is provided with vertical walls. Since the terminals are embedded in the material of the base portion, it is not necessary to seal them by means of an additional casting material. There is a certain difficulty, however, to realize a hermetic seal between the base portion and the cover, particularly because the relay body is mounted in the base portion and adjusted there. The adjustment requires recesses to be provided in the casing wall which create additional sealing difficulties. Also, contact and coil spaces are not separated from each other in this known relay.

It is a basic object of the invention to provide a relay which can be manufactured economically with constant quality and in which the sealing can be effected by a small number of process steps.

SUMMARY OF THE INVENTION

The electromagnetic relay of this invention comprises a bobbin having a coil wound thereon, at least one movable contact cooperating with at least one fixed contact, a base having bores in its bottom wall through which contact and coil terminals extend, and a peripheral wall projecting upwardly from the bottom wall, and a cover fit onto said peripheral wall of the base to form a casing for the relay. This structure allows effective sealing of the relay and exact positioning of the two casing portions. The sealing is performed e.g. by filling in a sealant from the lower side of the base portion.

In a preferred embodiment of the invention, the cover has a downwardly projecting peripheral edge portion engaging the outer surface of said peripheral wall of the base, the lower surface of said bottom wall being provided with grooves communicating with the lower ends of said bores, with passages connecting said grooves with openings provided in said peripheral wall of the base. Simultaneous sealing between the two casing portions and of the relay terminals with respect to the base portion of the casing is thereby achieved. The surface of the sealant entering the interior of the relay is extremely small so that the gases which diffuse out of the sealant are reduced to an amount harmless for the contact surfaces.

In a further preferred embodiment of the invention, partitions are provided in said grooves between the lower ends of said bores and passages, which partitions project downwardly from the bottom of said grooves to an extent smaller than the depth of the grooves. This ensures that the liquified sealant reaches substantially the same level above all bores and passages even in case the base portion should not be perfectly horizontal when the sealant is poured into the grooves. At the same time, the partitions increase the contact surface between the sealant and the grooves, thereby preventing the sealant from peeling off when stress is placed on the terminals.

In another preferred embodiment of the electrical relay of this invention, the bobbin has a central trunk portion carrying said coil and flange portions at opposite ends of the trunk portion, a pair of fixed contacts inserted in one of said flange portions and spaced by a separator integrally formed in one flange portion, the movable contact being constituted by a reed mounted at one end to a connecting portion inserted in the other flange portion, extending through the trunk portion, and having its free end located between the fixed contacts. This structure leads to a reed relay having a particularly well defined contact spacing, in which the free end of the reed is prevented from slanting with respect to the fixed contacts. This results not only in uniform relay characteristics but also in a long contact life, both mechanically and electrically, in addition to a simplification of the mould required for forming the bobbin.

It is also preferred to provide the base with an upwardly extending projection having at least one throughbore penetrating the projection, with an adjusting screw adapted to be inserted in the throughbore and having its tip engaging said reed connecting portion. The throughbore enables easy filling of the casing with a protective gas. After such filling has been done, the same bore receives the adjusting screw which serves for the final adjustment of the switching behaviour after assemblage of the relay has been completed. The relay is thus adjusted in the same magnetic field in which it is to operate in actual use. Also, mechanical stress resulting from the setting of the sealant to affect the contact system via the bobbin, may be equalized by the adjustment. An air-tight seal may thus be realized by simple means as a prerequisite for stable relay characteristics.

In a further preferred embodiment, the cover has a downwardly projecting peripheral edge portion engaging the inner surface of the peripheral wall of the base, with pockets for receiving sealant being provided between the mutually engaging cover edge portion and base wall, and a projection extending upwardly from the base bottom wall to confine areas in which the sealant is to be injected. The pockets may be formed either by recesses at the inner surface of the base wall or by a knurling of the lower edge portion of the cover. The sealant is thus restricted substantially to the area of the terminals so that mechanical stress on the coil by the setting sealant is almost perfectly avoided. The recesses at the inner surface of the base wall and the knurling of the lower edge portion of the cover improve the sealant flow and enlarge the surfaces of the casing portions at those locations where a tight seal is desired.

For improving the magnetic shielding and intensifying the magnetic flux, the cover is made of magnetically conductive metal, and a magnetic shielding plate is disposed between the relay body and the base. When using a cover of metal, an earth terminal is mounted on the bobbin which has a projection contacting the cover.

In another preferred embodiment, the bobbin trunk portion is open at its upper side, and the flange portion receiving the fixed contacts has a vertical opening extending throughout this flange portion. Because all portions are thus easy accessable and the bobbin has a free longitudinal side, the contact system is particularly easy to mount. The penetrating opening in the one bobbin flange portion results in a simplification of the moulds in addition to a considerable reduction of the tolerances of the separator defining the contact spacing.

A further simplification of the manufacturing process can be achieved by inserting the reed connecting portion at the dividing plane between upper and lower bobbin forming moulds, with the faces of the separator defining the contact spacing being formed by opposite surface portions of the upper and lower moulds. While U.S. Pat. No. 4,032,871 discloses a relay having a bobbin open at one side and a single reed contact pair, the structure of such known relay may not easily be adopted for a relay having a polarized switch-over contact system as in the present case.

It is also preferable that pole shoes connected to the fixed contacts are each provided with a projection on their sides opposite to the fixed contacts, and that the projections bear against inner surfaces of a chamber formed in the corresponding flange portion, with a permanent magnet being disposed between the pole shoes. Moreover, the permanent magnet may abut against an end face of the separator projecting beyond the free end of the reed. The reed relay of this structure can thus be assembled accurately with negligible variations in the contact spacing and in the magnetic flux. Mounting the permanent magnet between the pole shoes facilitates the assemblage of the fixed contact arrangement. At the same time, stable relay characteristics are obtained. The spacing between the free end of the reed and the permanent magnet is important for providing a defined magnetic shunt. The spacing to be achieved is related to the dimensions and locations of the fixed contacts and of the permanent magnet within the same chamber. Well-defined situations are achieved by the fact that both the fixed contacts and the permanent magnet abut against the same separator. Since it is desired to have the magnetic attraction force unaffected of the stray flux even in a monostable reed relay, this stray flux is magnetically partially short-circuited within the chamber. The magnetically effective flux is thus stabilized by utilizing the same chamber as the contact area and magnet area. Between both areas, the contact atmosphere may freely exchange so that organic gases and magnetic metal particles from the contact area may be absorbed by the permanent magnet thereby improving the contact reliability.

In another preferred embodiment, at least one coil terminal has a bendable portion which, prior to being bent, projects radially outwardly from the bobbin trunk portion to facilitate connection of the respective coil wire end to the coil terminal. An ear may be formed on a bobbin flange between the coil and the respective coil terminal, and the coil wire end is led over the ear along a bent path. Simple and secure contacting between the coil end and the coil terminal is thus achieved. By feeding the wire around the upper or lower shoulder of the ear—depending on the coiling direction—stress is releaved from the coil wire when the terminal portion is bent flush with the bobbin. This prevents the delicate coil wire from breaking.

In still a further preferred embodiment of the relay, the pole shoes and fixed contacts are formed as integral bent plates with cutouts provided at both ends of the bent portions and facing recesses provided in the contact receiving chamber. The recesses function as sealant sumps preventing the sealant used for mounting the magnet and sealing the end of the relay from flowing into the contact area, which would otherwise contaminate the contact surfaces, thereby create unstable or increased contact resistances.

BRIEF DESCRIPTION OF THE DRAWINGS

In the drawings:

FIG. 3 is a vertical longitudinal section of the relay shown in FIG. 1;

FIG. 4 is a partial horizontal longitudinal section of the relay of FIG. 1;

FIGS. 5 and 6 are vertical cross-sections of the relay taken along the lines V—V and, respectively, VI—VI in FIG. 4;

FIGS. 8 to 12 show an exploded view, a vertical longitudinal section, a partial horizontal longitudinal section and, respectively, vertical cross-sections of another relay embodiment, these views being similar to those shown in FIGS. 1 and 3 to 6;

FIG. 16 is a vertical longitudinal section of a relay according to a fourth embodiment;

DETAILED DESCRIPTION OF PREFERRED EMBODIMENTS

Figure 1:
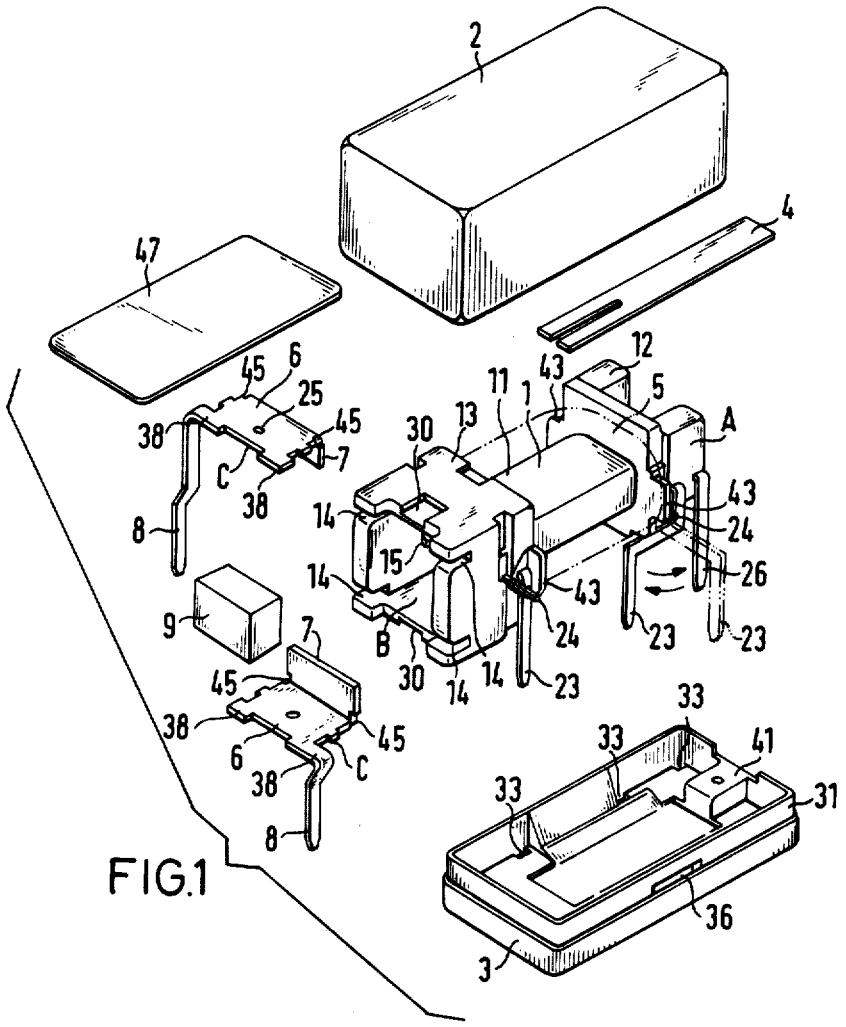
FIG. 1 is an exploded view of a polarized switch-over reed relay.

In the embodiment shown in FIGS. 1 to 6 of the drawings, a bobbin 1 comprises a hollow central trunk 11 and flange portions 12, 13 formed integrally with both ends of the trunk 11. The flange portions 12, 13 are provided with a total of four coil terminals 23, an earth terminal 21, and a reed terminal 26 integrated with a terminal strip 10, which are insert-moulded. Two of the four coil terminals 23 are provided at the flange portion 12 when the reed relay is used with a double-layer solenoid, but these terminals are broken off when used with a single-layer solenoid. 24 is each coiling portion of each coil terminal 23. To the portions 24 are wound coil wire ends at the beginning and end of the winding of a coil 5 wound on the outer periphery of the trunk 11, and then the terminal portions 24 are bent along the bobbin 1.

As seen from FIG. 1, the coil terminal 23 at the flange portion 12 extends toward the central trunk 11 and then downwardly from the bobbin 1. The reason for this is that the bobbin 1 is reduced in its whole length and the space for winding the coil 5 is enlarged, thereby improving the sensitivity thereof. The size of the flange portion 13, however, is dictated by the fact that it is to house a permanent magnet 9 and contact portions as described hereinafter, which leads to a reduction of the flange portion 12. The coil terminal 23 is first led to the coil 5 side and spaced by a larger pitch from other terminals, such as the earth terminal 21 and reed terminal 26, because if the coil terminal 23 is too close to other terminals, insulation problems arise. In case the coil terminal 23 positioned at the outer periphery of the coil 5 impedes the winding thereof, a bendable portion is provided, whereby the terminal 23 is, when winding the coil 5, turned outwardly as shown by the phantom line in FIG. 1 and thereafter, returned.

The wire ends of the coil 5 are wound to the portions 24 and thus electrically connected to the coil terminals 23. At this time, the coil wire ends are led along a bent path over the upper or lower shoulder of an ear 43 which has a substantial vertical width and projects at the lateral side of boundary of the central trunk 11 and the flange portions 12, 13, and thereafter connected to the respective terminal portions 24. The coil 5 is thus relieved from tension, regardless of the coil winding direction, when bending the terminal portions 24.

One flange portion 12 in which the reed terminal 26 and terminal strip 10 are inserted, is vertically open and the terminal strip 10 is exposed within the same, the terminal strip 10 being welded to one end of a reed 4 to be inserted into the central trunk 11. The other flange portion 13 is open at the end face thereof to form a chamber B having upper and lower thin walls 30. The chamber B communicates with the hollow central trunk 11 and has inner recesses 39 formed at both its upper and lower ends as shown in FIG. 3.

Fixed contacts 7 disposed within the chamber B are formed of bent and machined conductive magnetic plates. The fixed contacts 7, magnetic pole shoes 6 and fixed contact terminals 8 are integrated to constitute fixed contact blocks C, in which the fixed contacts 7 are bent at about right angles from the edges of pole shoes 6 opposite to the fixed contact terminals 8. Alternatively, the fixed contacts 7 may be welded to the pole shoes 6.

25 represents small hemispherical projections provided at the center of each pole shoe and extending reversely to the contacts 7 respectively. As shown in FIG. 1, the contact blocks C are press-fit into the chamber B with cutouts 14 at both vertical sides of the flange portion 13 retaining projections 38 formed at both lateral sides of the pole shoes 6, one of the projections 38 being the base of the fixed contact terminal 8. Therefore, the projections 25 are pressed onto both the upper and the lower inner surfaces of the chamber B and the fixed contacts 7 abut with their end faces against a separator 15 integrally formed within the flange portion 13. Thus, the pair of fixed contacts are inserted into the flange portion 13 and are in firm contact with the upper and lower surfaces of the separator 15 through the projections 38 retained by the cutouts 14 and the projections 25 pressed onto the inner surfaces of chamber B, whereby the spacing between both fixed contacts 7 and that between both polar plates 6 is always kept constant. The free end of the reed 4 is positioned between the fixed contacts 7.

Furthermore, at each block C inserted as aforegoing, cut-outs 45 are formed at both sides of the bent portion between the contact 7 and the pole shoe 6 and are positioned in front of recess 39 at the bottom of chamber B, as shown in FIG. 3, the cut-outs 45 together with the recesses 39 serving as sumps for adhesive to prevent the adhesive for fixing the permanent magnet 9 from flowing into the contact areas between the polar plate 6 and the inner surface of chamber B by capillary action, and also preventing locking of the reed 4, increase of contact resistance, and instability. Simultaneously, the cut-outs 45 eliminate difficulties in inserting the fixed contacts 7 the bent portions of which have increased thickness by bending.

The permanent magnet 9 to be disposed between both fixed contact blocks C is adhered to the magnetic pole shoe 6 in chamber B. In this instance, the permanent magnet 9 abuts against the fore end of the separator 15 to be spaced from the reed 4 by a defined distance. Thus, the separator 15 determines not only the movable range of the reed 4, i.e. the spacing between the two fixed contacts 7, but also the short-circuit magnetic flux from the permanent magnet 9 to the reed 4 at monostable operation.

The contacts and permanent magnet are provided in the same chamber B and have no shield therebetween, whereby the permanent magnet 9 acts as a getter adsorbing any organic gas from the contacts and magnetic metallic powder entering the contacts, thus improving the reliability of the contacts.

If the permanent magnet 9 is fixed to the lower pole shoe 6 to perform the monostable operation mentioned above, the lower fixed contact 7 is a normally closed (NC) contact and upper contact 7 is a normally open (NO) contact. In this operation, the reed 4 contacts with the lower fixed contact 7 against spring force of the same by the attraction of the permanent magnet 9. When the coil 5 is energized to magnetize the reed 4 in the same polarity with lower fixed contact 7, the reed 4 moves apart therefrom to contact with the upper fixed contact 7. The reed 4 returns when the excitation of the coil 5 ceases.

The relay body A, so far described is housed and sealed within a casing formed by a cover 2 and a base 3. The cover 2 is made of magnetic metal for magnetic shielding, and the base 3 is made of synthetic resin for insulation. The base 3 has a peripheral wall 31 extending upwardly from its bottom wall, which has at the lower surface a plurality of insertion bores 33 disposed as shown. In addition, a projection 41 is provided to engage the flange portion 12 and position the base 3.

Figure 2:
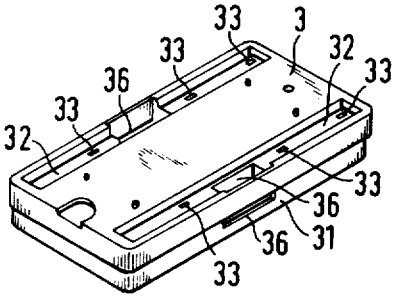
FIG. 2 shows the base used in the relay of FIG. 1 from below.

As shown in FIG. 2, the base 3 is provided at its lower surface with grooves 32 along and near both side edges thereof. The grooves 32 communicate with the insertion bores 33 at the lower ends thereof. Substantially vertical passages 36 open at one end thereof within the grooves 32 and at the other end at the outer surface of the peripheral wall 31.

Assembly of the casing for housing the relay body is carried out by placing the relay body A onto the upper surface of the base 3, inserting the terminal groups through the bores 33, placing a sheet of insulating paper 47 and the cover 2 on the relay body and fitting the lower edge of the cover 2 onto the outer surface of the wall 31 of the base 3, and finally connecting base and cover by an adhesive sealant 35 which is filled into the grooves 32. The material 35 hardens to seal the insertion bores 33 opening at the grooves 32 and embed the terminals inserted in the bores, and simultaneously flows through the passages 36 to reach the outer surface of the wall 31 and flow through the tiny gap between the cover 2 and the wall 31, thus adhering and sealing them throughout the periphery thereof. Thus, the adhesive sealant is only once charged into the grooves 32 to simultaneously stick and seal the base 3 and cover 2 and the vicinity of each terminal, thereby improving the workability and simplifying the assembly process.

Also, the surface area of the adhesive sealant within the casing is considerably reduced, whereby the amount of gas emitted from the sealant 35 is almost negligible, thus improving contact reliability. Furthermore, the sealant is not charged within the casing, so that the space is utilized to enlarge the insulation distance. Still further, the outer surface of the wall 31 is utilized to enlarge the contact area of the base 3 and the cover 2, increase adhesive strength therebetween, and improve the sealing ability. When the relay is mounted to a printed circuit board (not shown), the lower opening edge of the metallic cover 2 is positioned above the bottom of base 3 to enlarge the creepage distance from the cover 2 to such printed circuit board.

The magnetic resistance between the upper pole shoe 6 at the NO contact side and the reed 4 is much smaller, due to the magnetic metal of the cover 2, than that between the pole shoe 6 and the NC contact side and the reed 4 through the cover 2 and base 3, whereby the attraction applied to the reed 4 from the fixed contact 7 at the NC contact side together with the aforesaid short-circuit magnetic flux, when the coil 5 is not excited, becomes larger than that applied to the reed 4 from the fixed contact 7 at the NO contact, when not excited. The lower edge of the cover 2 of magnetic metal is nearly level with the pole shoe 6 at the NC contact side, whereas it is considerably lower than the pole shoe 6 at the NO contact side. Thus, the difference of attraction forces, when the coil is excited, between the NC contact side and the NO contact side becomes large and an attraction force characteristic more suitable for monostable operation is obtained. It is preferable to make the dimensions of a, b, c and d shown in FIGS. 3 as a:b=8:1 to 3 and d:c=1:1 to 0.

Figure 7:
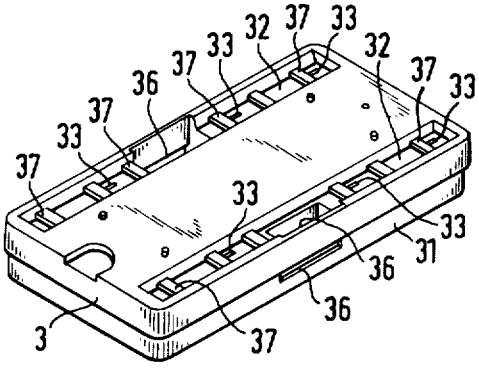
FIG. 7 is a perspective view showing a modified base portion from below.

A modified embodiment of the invention is shown in FIG. 7, in which a plurality of partitions 37 are provided within the grooves 32 at the lower surface of the base 3. The partitions 37 separate the insertion bores 33 and vertical passage 36 from each other so that the adhesive sealant 35 may be ensured to have constant thickness at every portion. Provision of the partitions 37 also prevents solidified adhesive sealant 35 from peeling by bending of the terminals, and thus deteriorating the airtight seal of the casing. In addition, the partitions 37 are smaller in height than the grooves 32 in depth so that the adhesive sealant 35 may spread without hindrance.

In the embodiment shown in FIGS. 8 to 12, the relay body is sealed by the base 3 and cover 2, the cover 2 being made of magnetic metal and formed in a box-like shape opening downwardly. The base 3 is moulded of synthetic resin and formed in a vertically thin box-like shape opening upwardly and having at the bottom insertion bores 33 for terminals, a projection 34 extending upwardly to be pressed into the bobbin 1, and a projection 41 having a vertical through-bore 42. The base 3 is larger than the cover 2, so that the latter may be fit within the peripheral wall of the base 3.

When the terminals have been inserted through the bores 33, the base 3 is interlaced with the cover 2, and then sealant 35 is injected from below of the base 3, into which the cover 2 is fit at its lower edge. The sealant 35 seals the bores 33 and gaps around the terminals inserted into the bores and peripheries thereof, simultaneously sticking and sealing the inner surface of the peripheral wall of the base 3 in contact with the outer surface at the lower edge of the cover 2. Hence, the cover 2 and base 3 and the relay body are simultaneously stuck and sealed.

Air-pressure rise within the relay caused by the heating following the hardening of the sealant 35 is removed through an unsealed bore 42 through which the interior of the relay communicates with the open air, thereby preventing production of pin holes at the adhesion surface of the sealant 35. Also, organic gas within the relay can be removed through the bore 42 to raise the contact reliability. The bore 42 is sealed at the final process step during which injection of inactive gas can be readily carried out.

Figure 8:
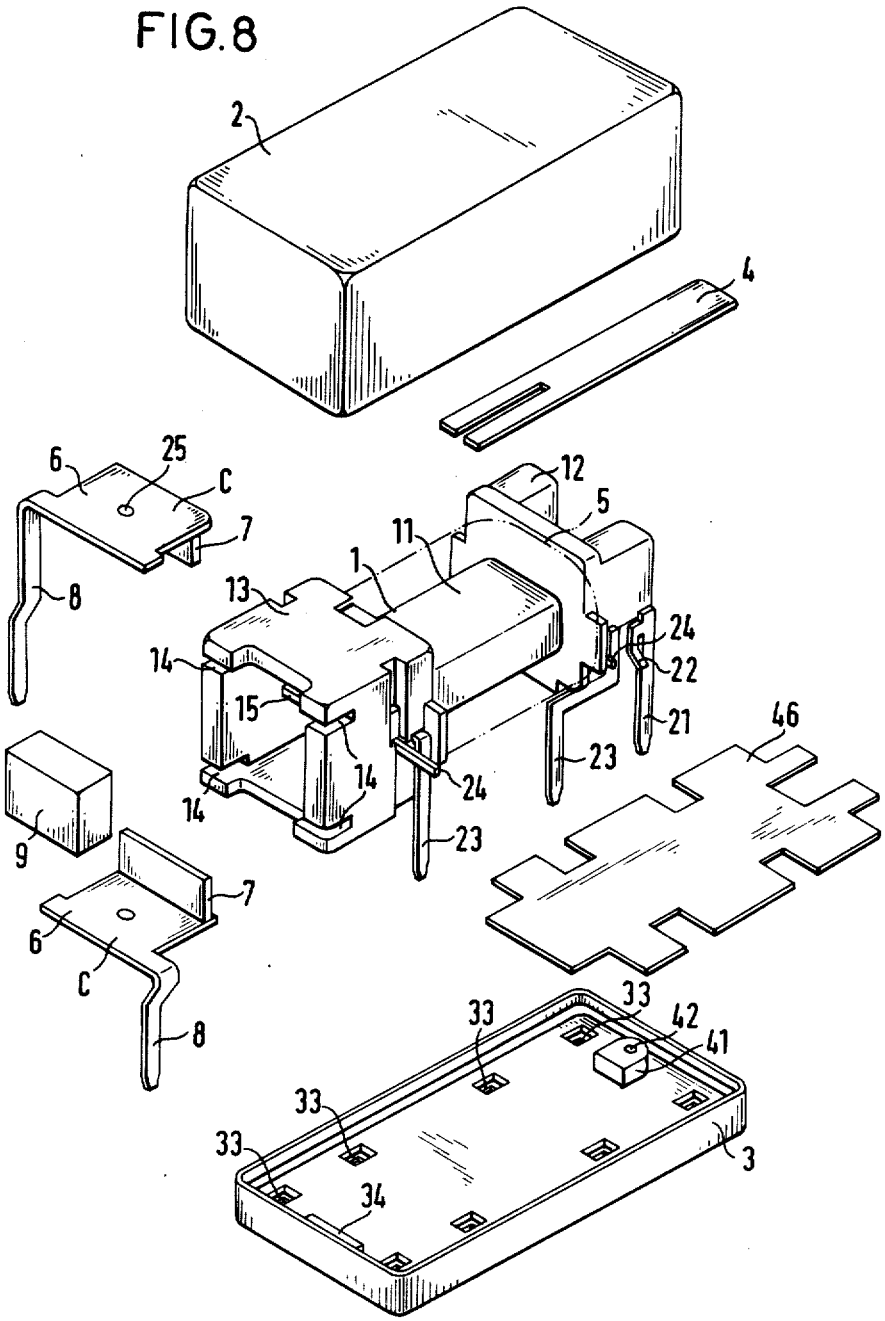
Figure 10:
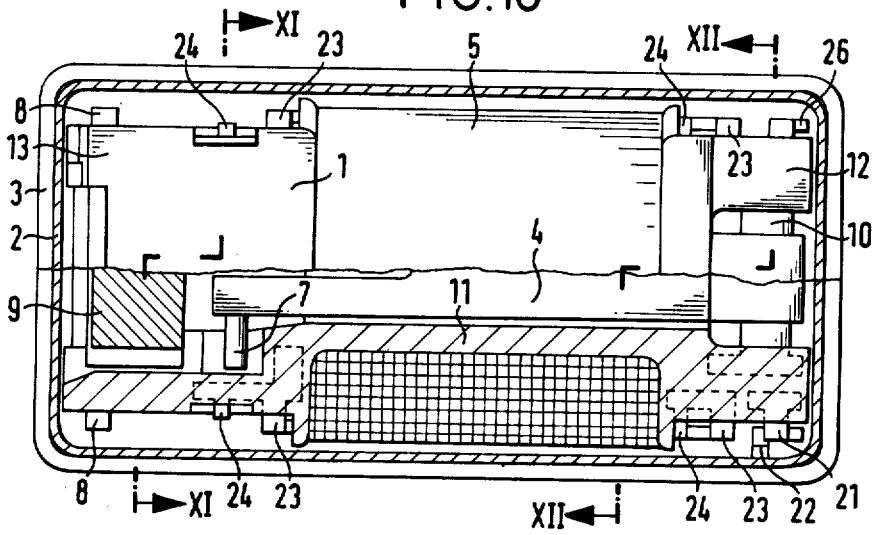
Figure 11:
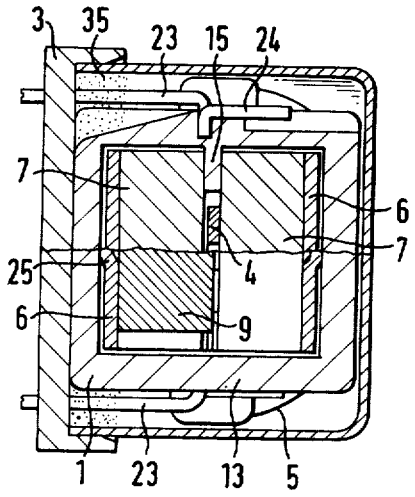
Figure 12:
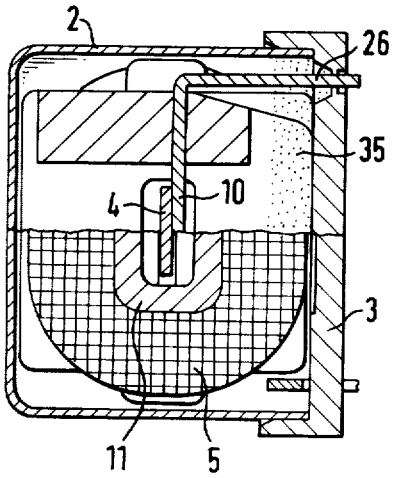

The relay hermetically sealed as aforegoing has the cover 2 acting as a magnetic shielding case. When interlaced with the base 3, the cover 2 contacts through a tongue 22 connected to the earth terminal 21 and bent laterally therefrom. This grounding reduces electrostatic capacity between the contacts. In addition, for the purpose of downwardly magnetic-shielding, especially against a printed circuit board on which the relay may be mounted, a magnetic shielding plate 46 may be inserted between the lower surface of the relay body and the base 3 as shown in FIGS. 8 and 9, the plate 46 being provided at its periphery with cutouts as shown for insulation from each terminal. Thus, the cover 2 and the magnetic-shielding plate 46 reliably shield the whole relay against effects from external magnetic fields.

The electrical part of the relay illustrated in FIGS. 8 to 12 is similar to that of FIGS. 1 to 6. It may be noted, however, that each fixed contact 7 is fixed to the respective pole shoe 6 by spot welding or laser welding. As before, the pole shoes 6 are formed of electrically conductive material and have the fixed contact terminals 8 formed integrally therewith, thus constituting the fixed contact blocks C in combination with the welded fixed contacts 7. As before, opposite faces of the fixed contacts 7, abut against both vertical sides of the separators 15, thereby rendering the spacing between the fixed contacts 7 equal to the thickness of the separators. Hence, the spacing is always kept constant. The reed 4, the free end of which is positioned between the fixed contacts 7, is fixed at the other end to the terminal strip 10 inserted along the parting line of the upper and lower metallic moulds forming the bobbin, whereby slanting between the fixed contacts 7 and the reed 4 is substantially avoided. As a result, stable operation characteristics are obtained. In addition, the bifurcated free end of the reed 4 and the fixed contacts 7 are plated at their contact portions or throughout.

Figure 15:
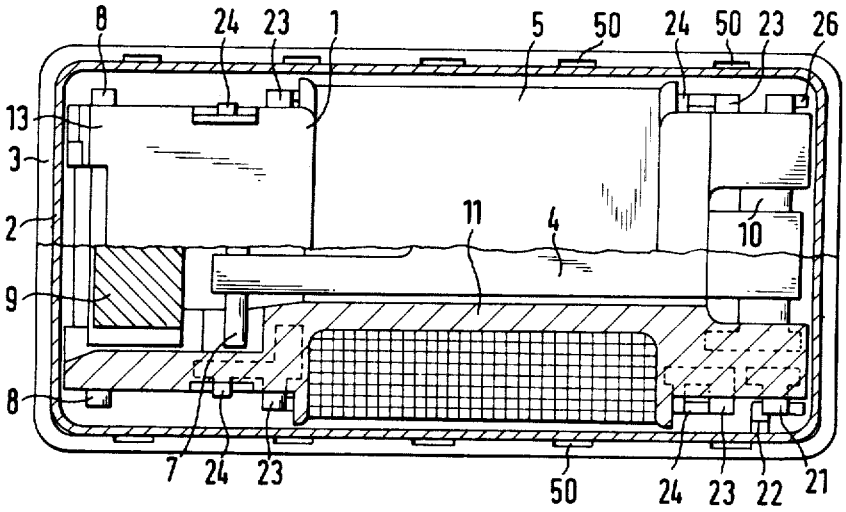
FIGS. 14 and 15 show a horizontal longitudinal section and, respectively, a vertical cross-section of the relay shown in FIG. 13.
Figure 14:
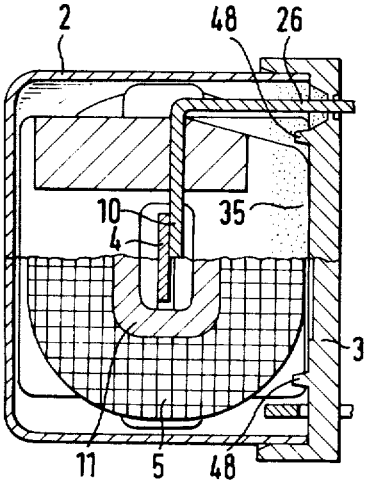
Figure 13:
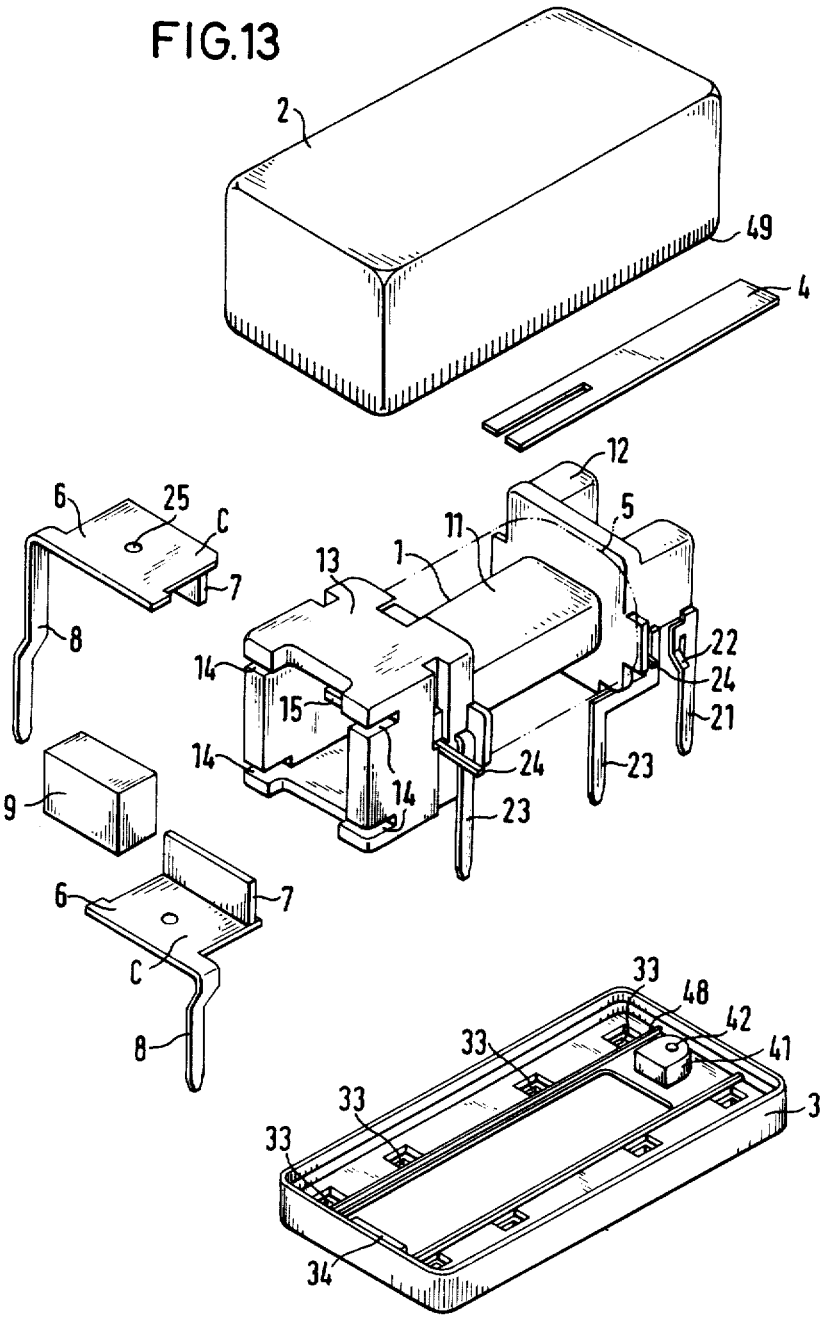
FIG. 13 represents an exploded view of a third embodiment of the relay.
Figure 17:
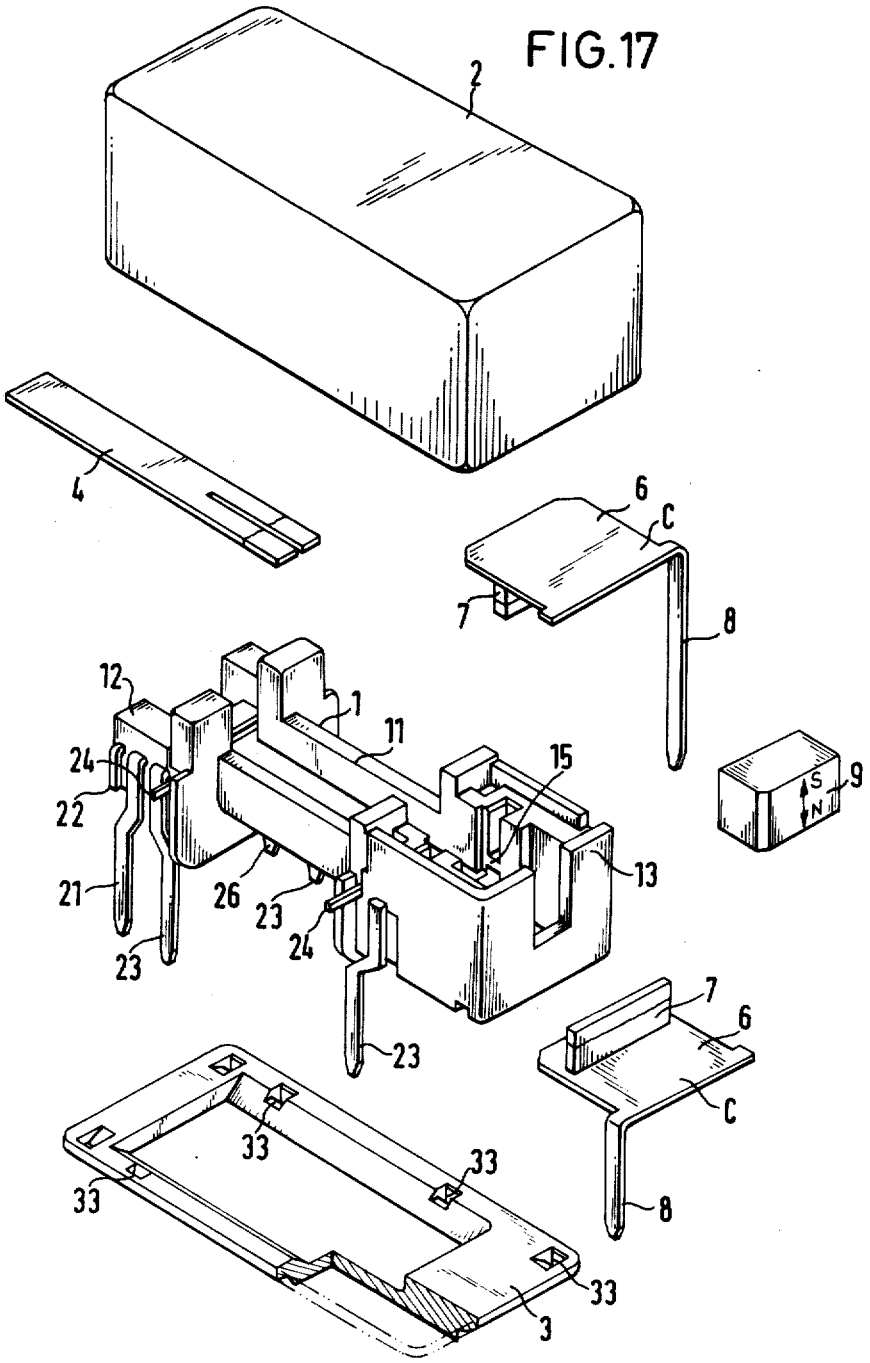
FIGS. 17 to 21 are views, again similar to those shown in FIGS. 1 and 3 to 6, of a fifth embodiment of an electromagnetic relay.
Figure 18:
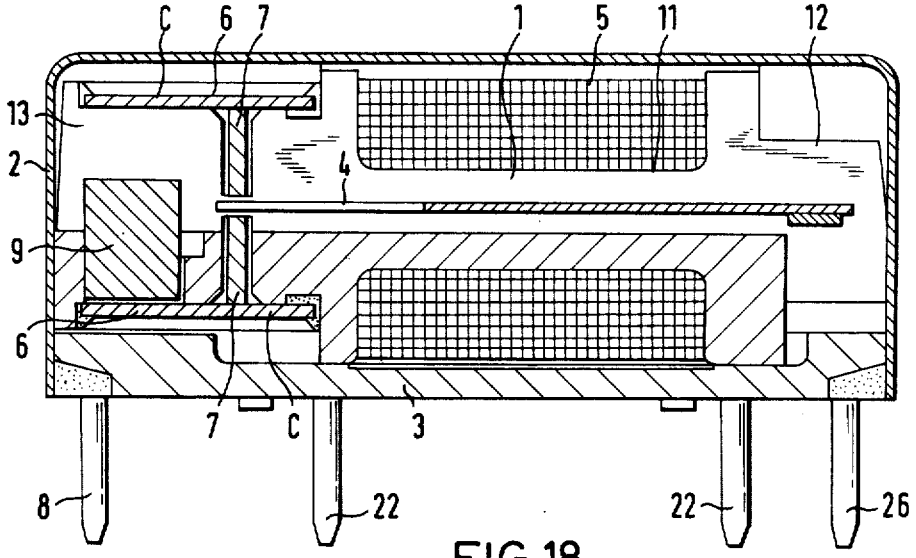
Figure 19:
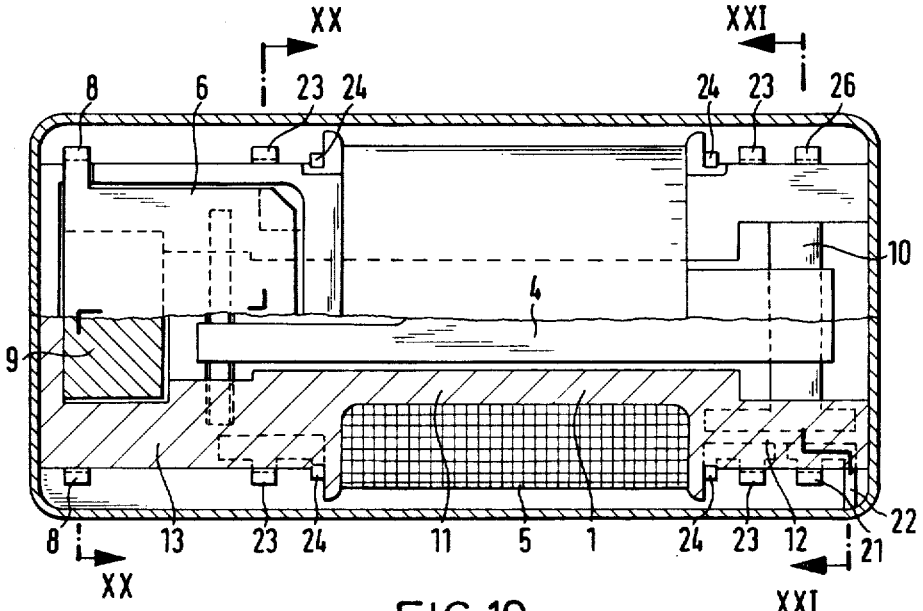
Figure 20:
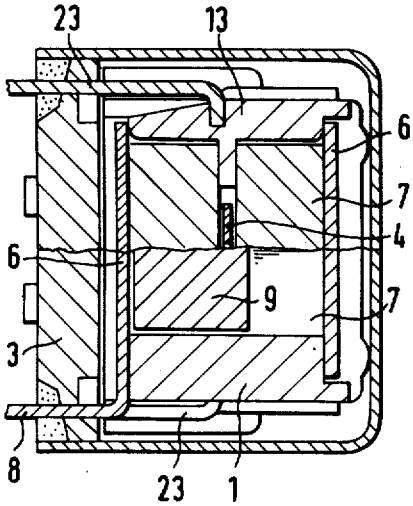
Figure 21:
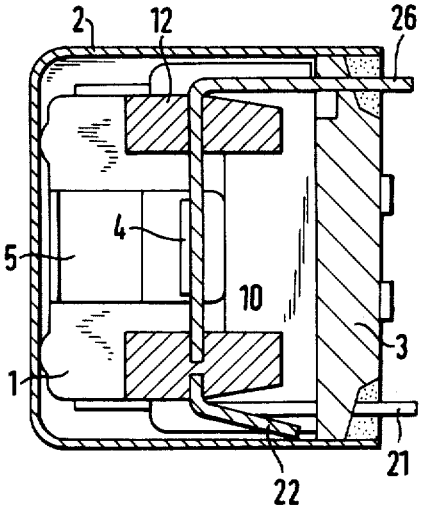
Figure 22:
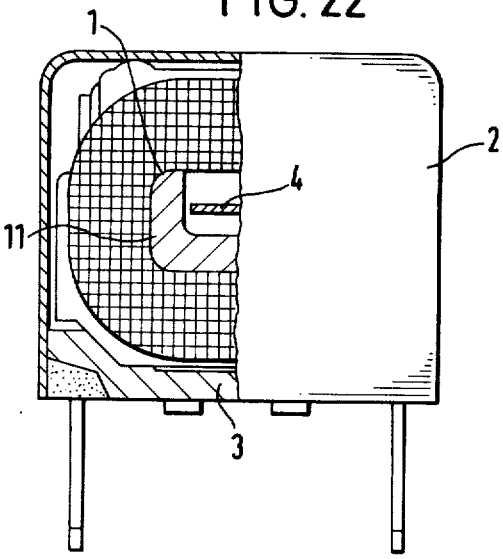
FIG. 22 is an additional, partial cross-section through the relay of FIGS. 17 to 21.

The embodiment shown in FIGS. 13 through 15 represents an improvement of the sealing by the sealant 35. A small web 48 in FIG. 13 at the upper surface of the base 3 surrounds the insertion bores 33 to ensure the sealant to be kept in the bores. Tiny pockets formed, for example, by a knurling 49 at the outer surface of the peripheral edge of the cover 2 as shown in FIG. 13 and/or recesses 50 provided at the inner surface of the surrounding wall of the base 3 as shown in FIG. 15 serve to raise the filling effect of the sealant to improve the airtight seal at the abutment of the cover 2 against the base 3. In addition, the recesses 50 may be replaced by small knurls.

Referring to FIG. 16, an embodiment is shown which utilizes the through bore 42 to enable an adjustment of the open-circuit voltage after assembly. In detail, the through bore 42 is disposed right below the terminal strip 10 fixing one end of reed 4 and is female-screw-threaded so that an adjusting screw 44 may be screwed through the bore 42 to abut at its tip against the lower surface of the terminal strip 10. By manipulating the adjusting screw 44, the urging force on the terminal strip 10 is varied to enable fine adjustment of the position of the fixed end of the reed 4. As a result, the open-circuit voltage can be adjusted after the assembly has been completed. Hence, even when the injection and solidification of sealant apply stress on the bobbin to change the relay characteristics, the adjusting screw 44 may still be adjusted after the base 3, the cover 2 and the bobbin 1 have become a rigid unit. Upon completion of the adjustment, the screw 44 is stuck to the base 3 with an adhesive and then sealed for being locked and kept air-tight.

Another modified embodiment is shown in FIGS. 17 through 22. This embodiment facilitates the moulding of the bobbin 1 and the mounting of the reed 4 and eliminates slanting between the fixed contacts 7 and the reed 4. This bobbin is designed to be moulded only with an upper and a lower metallic mould and disposes of the need of side cores as used in the former embodiments. In detail, the bobbin 1 is open upwardly at the central trunk portion 11 thereof, and both flange portions 12, 13 open vertically so that the pair of fixed contact blocks C may be inserted from the top and bottom respectively.

The separator 15 is so constituted that one surface thereof is formed by the lower mould and the other surface by the upper mould fit to the lower mould along the parting line thereof. Also the terminal strip 10 for fixing the reed 4 is held at the parting line between upper and lower moulds. The fixed contact blocks C are fixed to the flange portion 13 so that the fixed contacts 7 may be pressed in contact with the separator 15. Thus, the terminal strip 10 fixing one end of the reed 4 and the separator 15 defining the spacing between both fixed contacts 7 are formed by the upper and lower moulds fit to each other, thereby obtaining a very precise parallel arrangement which results in stable working characteristics and a long life. The upwardly opening central trunk portion 11 facilitates mounting of the reed 4, without any fear that the bifurcated free end of the reed may become deformed when inserted into the trunk portion, as may happen when inserting the reed through an end face of the trunk portion. Also, the fixed contact blocks C are vertically inserted simultaneously with the reed 4. Then, the base 3 is inserted within the cover 2 in this embodiment in a manner similar to the previous embodiments.

We claim:

1. An electromagnetic relay comprising a bobbin having a coil wound thereon;

at least one fixed contact disposed relative to said bobbin and having a contact terminal;

at least one magnetically movable contact disposed for cooperating with said at least one fixed contact in dependence upon energization of said coil;

coil terminals connected to respective ends of said coil;

a base having bores in its bottom wall through which said contact and coil terminals extend, and a peripheral wall projecting upwardly from said bottom wall; and a cover fit onto said peripheral wall of said base to form a casing for said relay, wherein said cover has a downwardly projecting peripheral edge portion engaging the inner surface of said peripheral wall of said base, pockets for receiving a sealant being provided between said mutually engaging cover edge portion and base wall, and a projection extending upwardly from said base bottom wall to confine areas in which the sealant is to be injected.

2. The relay of claim 1, wherein said bobbin has a central trunk portion carrying said coil and a flange portion at opposite ends of said trunk portion, a pair of fixed contacts inserted in one of said flange portions and being spaced by a separator integrally formed in said one flange portion, said movable contact being constituted by a reed mounted at one end to a connecting portion inserted in the other of said flange portions, extending through said trunk portion, and having its free end located between said fixed contacts.

3. The relay of claim 2, wherein said base has an upwardly extending projection with at least one throughbore penetrating said projection.

4. The relay of claim 3, comprising an adjusting screw inserted in said throughbore and having a tip portion engaging said reed connecting portion.

5. The relay of claim 1, wherein said pockets are formed by recesses in said inner surface of said base wall.

6. The relay of claim 1, wherein said pockets are formed by a knurling of said lower edge portion of said cover.

7. The relay of claim 1, wherein said cover is made of magnetically conductive metal and a magnetic shielding plate is disposed between said bobbin and said base.

8. The relay of claim 1, wherein said cover is made of metal and an earth terminal is mounted on said bobbin and has a projection contacting said cover.

9. The relay of claim 2, wherein said bobbin trunk portion is open at its upper side and said one flange portion has a vertical opening extending throughout said one flange portion.

10. The relay of claim 9, wherein said reed connecting portion is inserted at the dividing plane between upper and lower bobbin forming molds, the faces of the separator defining the spacing between said fixed contacts being formed by opposing surface portions of said upper and lower molds.

11. The relay of claim 2, wherein pole shoes connected to said fixed contacts are each provided with a projection on their sides opposite to said fixed contacts, said projections bearing against inner surfaces of a chamber formed in said one flange portion, a permanent magnet being disposed between said pole shoes.

12. The relay of claim 11, wherein said permanent magnet abuts against an end face of said separator projecting beyond the free end of said reed.

13. The relay of claim 1, wherein at least one of said coil terminals has a bendable portion which, prior to being bent, projects radially outwardly from said bobbin trunk portion to facilitate connection of the respective coil wire end to said coil terminal.

14. The relay of claim 13, wherein an ear is formed on a bobbin flange between said coil and said coil terminal over which said coil wire end is led along a bent path.

15. The relay of claim 11, wherein said pole shoes and fixed contacts are formed as integral bent plates with cutouts provided at both ends of the bent portions and facing recesses provided in said chamber.

* * * * *